United States Patent [19]

Emmert et al.

[11] Patent Number: 4,720,306

[45] Date of Patent: Jan. 19, 1988

[54] CLEANING METHOD

[75] Inventors: Hermann Emmert, Erlangen; Herbert Hehs, Klettgau; Detlev Coerlin; Klaus Kuhnke, both of Erlangen, all of Fed. Rep. of Germany

[73] Assignee: Kraftwerk Union Aktiengesellschaft, Mülheim, Fed. Rep. of Germany

[21] Appl. No.: 852,131

[22] Filed: Apr. 15, 1986

[30] Foreign Application Priority Data

Apr. 16, 1985 [DE] Fed. Rep. of Germany ..... 3513676
Sep. 23, 1985 [DE] Fed. Rep. of Germany ..... 3533886

[51] Int. Cl.[4] ..... C23G 1/02; B08B 9/04; B08B 9/00; B08B 30/00

[52] U.S. Cl. ..... 134/3; 134/8; 134/22.13; 134/22.14; 134/22.19; 134/28; 134/29

[58] Field of Search ..... 134/3, 8, 22.13, 22.14, 134/22.19, 28, 29

[56] References Cited

U.S. PATENT DOCUMENTS

| | | | |
|---|---|---|---|
| 2,465,228 | 3/1949 | Hein | 134/3 |
| 2,567,835 | 9/1951 | Alquist et al. | 134/22.17 X |
| 3,000,767 | 9/1961 | Elliott | 134/3 |
| 3,537,895 | 11/1970 | Lancy | 134/3 |
| 3,686,123 | 8/1972 | Hiroshi | 134/3 X |
| 3,754,990 | 8/1973 | Teumac et al. | 134/3 X |
| 3,996,062 | 12/1976 | Frost et al. | 134/3 X |
| 4,051,057 | 9/1977 | Ericson et al. | 134/3 X |
| 4,443,268 | 4/1984 | Cook | 134/28 X |
| 4,452,643 | 6/1984 | Martin et al. | 134/3 |
| 4,510,018 | 4/1985 | McGowan | 134/3 X |
| 4,578,162 | 3/1986 | McIntyre et al. | 134/28 X |
| 4,586,961 | 5/1986 | Bradley et al. | 134/29 X |
| 4,600,443 | 7/1986 | Basalyk et al. | 134/28 X |
| 4,632,705 | 12/1986 | Baum | 134/22.19 X |

FOREIGN PATENT DOCUMENTS

| | | |
|---|---|---|
| 441037 | 5/1970 | Australia . |
| 54-117327 | 9/1979 | Japan . |

*Primary Examiner*—Andrew H. Metz
*Assistant Examiner*—William G. Wright
*Attorney, Agent, or Firm*—Herbert L. Lerner; Laurence A. Greenberg

[57] ABSTRACT

Method for cleaning vessels and in particular, steam generators, having deposits which are dissolved chemically and removed mechanically. The copper compounds present in the deposits are dissolved chemically and subsequently, loose deposits and liquids are removed mechanically. Encrustations still remaining are softened chemically and finally, the loosened deposits as well as the remaining chemicals are flushed out.

5 Claims, No Drawings

CLEANING METHOD

BACKGROUND OF THE INVENTION

1. Field of the Invention

The invention relates to a method for cleaning vessels, particularly steam generators, in which solid deposits on the surfaces of the vessels are dissolved chemically and removed mechanically.

2. Description of the Prior Art

In steam generators, the heat transfer is inhibited by deposited corrosion products. In addition, enrichment of salts and copper compounds leads to further corrosion of the heating tubes in the steam generator. Consequently, it is most important, indeed almost essential, to at least periodically remove the encrustation on the vessels.

Up to now, two different cleaning methods, known generally as a mechanical cleaning method and a chemical cleaning method were employed to remove solids deposited on vessel surfaces. These two methods have been used separately, i.e. either the mechanical or the chemical method was used but not both. Most commonly, deposits have been removed by regular application of a mechanical cleaning method. However, this procedure is not entirely satisfactory because in the steam generator, hard encrustations remain, which are enriched by calcium salts and copper salts. A purely mechanical method therefore cleans the steam generator incompletely. With a chemical cleaning method, all deposits are dissolved chemically and are then separated either by precipitation, by filtration or by ion exchange, or are removed together with the solution. This requires considerable time and relatively many waste materials must be removed. Purely chemical cleaning of steam generators is therefore not economical because of the high cost.

SUMMARY OF THE INVENTION

It is an object of the invention to provide a simple, cost-effective and nevertheless reliable cleaning method. Since especially copper compounds contribute heavily to the corrosion and, in addition, impede other cleaning processes, copper compounds are to be removed from the steam generator by the method according to the invention. The further cleaning is then be carried out with little effort.

With the foregoing and other objects in view, there is provided in accordance with the invention a method for cleaning vessels and in particular, steam generators, to remove therefrom encrustations or solid deposits containing copper compounds together with hard-to-dissolve metal-containing substances other than copper, which comprises (a) chemically dissolving the upper compounds contained in the encrustations by passing an aqueous solution containing a reactant which will react with the copper compound to form a soluble copper compound in contact with the encrustations (b) mechanically removing loose deposits and liquid from the vessel contaminated with encrustations after the chemical treatment of dissolving the copper compounds (c) chemically treating the residual encrustations after removal of loose deposits and liquid to effect at least partial dissolution of the hard-to-dissolve substances and softening of the residual encrustations, and (d) flushing-out loosened deposits as well as the remaining chemicals in the vessel after the chemical treatment of the residual encrustations.

Other features which are considered as characteristic for the invention are set forth in the appended claims.

Although the invention is illustrated and described herein as embodied in a cleaning method, it is nevertheless not intended to be limited to the details shown since various modifications may be made therein without departing from the spirit of the invention and within the scope and range of equivalents of the claims.

DESCRIPTION OF THE PREFERRED EMBODIMENTS

According to the invention, copper compounds present in the deposits in the vessel are dissolved chemically and subsequently loose deposits and liquids are removed mechanically. Then encrustations still remaining are softened chemically, and finally, the loosened deposits as well as the remaining chemicals are flushed out.

The cleaning method according to the invention is thus carried out in four steps:

1. Dissolution of the copper compounds.
2. Mechanical cleaning.
3. Chemical dissolution or softening of the still remaining encrustations.
4. Flushing-out of the loosened deposits and the remaining chemicals.

The method for cleaning vessels, particularly steam generators, according to the invention, enhances the success of the cleaning and the costs are optimized. Cleaning is achieved with little effort.

The copper compounds present are dissolved chemically, for instance, by adding to an aqueous solution suitable known ligands, whereby soluble complexes of the copper salts are formed.

Thereby, the copper compounds which interfere with almost all chemical cleaning processes, are removed in a simple manner. The aqueous solution containing the copper complexes is removed together with loose deposits in a first mechanical cleaning process.

After the copper compounds have been removed, encrustations remain in the steam generator which consist predominantly of iron oxide but also contain nickel, chromium, zinc and calcium, predominantly as compounds in the form of phosphates and carbonates. These encrustations of metal compounds made up principally of metal oxides and metal salts are sparingly soluble in water and most difficult to dissolve.

These hard-to-dissolve substances are loosened or at least partially dissolved, for instance, by the addition of acids and then are largely removed by a second mechanical cleaning.

The hard-to-dissolve substances are converted into soluble salts by an acid, for instance, citric acid. However, this relatively strong acid can attack metal parts of the steam generator. It is therefore necessary to thoroughly rinse out all residual acid in the course of the second mechanical cleaning.

According to another example, the hard-to-dissolve substances are converted into water-soluble complexes by adding suitable acids. This conversion is possible because all copper compounds were removed previously. By using only weak acids, the final mechanical cleaning is simplified.

Copper salts are dissolved selectively from the steam generator deposits, by adding, for instance an aqueous solution of ethylene diamine and $(NH_4)_2CO_3$ to form readily soluble copper-amine complexes. In the process, the pH-value is increased to a value larger than pH 10 by adding $NH_4OH$ and the temperature in the steam generator is kept below 80° C. After a reaction period of at least 24 hours, the steam generator is flushed with deionate for at least 1 hour. This effects the dissolution and separation of copper compounds from the deposits in the steam generator.

An acid suitable for dissolving the encrustations in the steam generator after removal of the copper compounds is citric acid which is recirculated for 24 hours. The encrustations may also be removed by forming water-soluble complexes by the addition of EDTA (ethylene diamine tetraacetic acid) or DCTA (diaminocyclohexane tetraacetic acid) as well as of $NH_4OH$ for increasing the pH-value to pH=10.5.

Thereafter, the steam generator is rinsed until the conductivity of the rinse water has fallen below a predetermined value indicating substantial removal of soluble corrosive material in the steam generator.

Deposits of metallic copper are chemically not changed by the method for the chemical dissolution of copper compounds since ligands suitable for the formation of complexes in copper compounds do not form complexes with metallic copper. Also, deposits of metallic copper which cannot be attacked mechanically cannot be removed with acids.

According to the method of the invention, metallic copper is removed, for instance, by introducing hydrogen peroxide as the first process step into the contaminated vessels. Thereby, the metallic copper is oxidized. Thereupon, the remaining four steps of the cleaning process follow. The copper oxide produced is dissolved and removed together with existing copper compounds.

With the method according to the invention, a particular advantage which is achieved is that steam generators are cleaned fast and reliably with little effort and, in particular, copper compounds are dissolved without leaving a residue.

There is claimed:

1. Method for cleaning vessels, in particular steam generators, to remove therefrom incrustations or solid deposits containing copper compounds together with hard-to-dissolve metal-containing substances other than copper, which comprises: passing an aqueous solution containing ammonia and ethylenediamine into a vessel in contact with deposits therein to chemically dissolve copper compounds contained in the deposits by the formation of copper complexes, whereby first ammonium complexes and then soluble ethylenediamine chelates of the copper compounds are formed, mechanically removing loose deposits and liquid from the vessel after the chemical treatment of dissolving the copper compounds, chemically treating the residual deposits to effect at least partial dissolution and softening of the residual deposits, and flushing-out loosened deposits as well as remaining chemicals in the vessel after the chemical treatment of the residual deposits.

2. Method according to claim 1, wherein ammonium carbonate is added into the aqueous solution containing ammonia and ethylenediamine to increase electrical conductivity of said solution.

3. Method according to claim 1, wherein a strong acid which can dissolve substances which are hard to dissolve is filled into the vessel after the copper compounds have been removed.

4. Method according to claim 1, wherein after the copper compounds have been removed, a weak acid is filled into the containers, which acid forms complexes with the substances which are difficult to dissolve, which complexes are more easily dissolved.

5. Method according to claim 1, wherein, before the copper compounds are removed, hydrogen peroxide is introduced into the containers for the oxidation of deposits of metallic copper.

* * * * *